United States Patent [19]

Goss et al.

[11] 4,345,368

[45] Aug. 24, 1982

[54] PARALLEL-TYPE HEATING CABLE AND METHOD OF MAKING SAME

[75] Inventors: David C. Goss; Daniel R. Springs, both of San Marcos, Tex.

[73] Assignee: Thermon Manufacturing Co., San Marcos, Tex.

[21] Appl. No.: 188,354

[22] Filed: Sep. 18, 1980

[51] Int. Cl.[3] ..... H05B 3/00

[52] U.S. Cl. ..... 29/611; 219/549; 338/214

[58] Field of Search ..... 219/528, 549; 338/214; 29/611, 613

[56] References Cited

U.S. PATENT DOCUMENTS

| | | | |
|---|---|---|---|
| 2,251,697 | 8/1941 | Van Daam et al. | 219/46 |
| 2,494,589 | 1/1950 | Sletner | 201/63 |
| 2,559,077 | 7/1951 | Johnson et al. | 201/46 |
| 2,710,909 | 6/1955 | Logan et al. | 219/46 |
| 2,719,907 | 10/1955 | Combs | 219/46 |
| 2,858,401 | 10/1958 | Andrews | 29/611 X |
| 3,341,690 | 9/1967 | Commins | 219/528 |
| 3,683,361 | 8/1972 | Salzwedel | 338/322 |
| 3,740,529 | 6/1973 | Falk | 219/535 |
| 3,757,086 | 9/1973 | Indoe | 219/528 |
| 3,812,580 | 5/1974 | Drugmand | 29/611 |
| 3,889,362 | 6/1975 | Tyler | 29/611 X |
| 3,928,909 | 12/1975 | Saku | 29/611 |
| 3,964,959 | 6/1976 | Adams | 156/433 |
| 4,039,995 | 8/1977 | Walton et al. | 29/611 X |
| 4,055,526 | 10/1977 | Kiyokawa et al. | 264/22 |
| 4,072,848 | 2/1978 | Johnson et al. | 219/528 |
| 4,100,673 | 7/1978 | Leavines | 29/611 |
| 4,200,973 | 5/1980 | Frarkas | 29/611 |
| 4,250,400 | 2/1981 | Lee | 219/549 |

FOREIGN PATENT DOCUMENTS 964709 3/1975 Canada .

*Primary Examiner*—Leon Gilden

*Attorney, Agent, or Firm*—Pravel, Gambrell, Hewitt, Kirk, Kimball & Dodge

[57] ABSTRACT

A method and apparatus for parallel-type heating cables. In accordance with the present invention a heating core element is formed by connecting two essentially parallel bus wires with a plurality of electrically conductive splices to a centrally disposed resistive element and around which heating core element a protective sheath is formed. The present invention permits this heating core element to be formed by splicing the spaced apart, essentially parallel wire elements followed by a single extrusion application of a protective sheath.

9 Claims, 7 Drawing Figures

PARALLEL-TYPE HEATING CABLE AND METHOD OF MAKING SAME

FIELD OF THE INVENTION

This invention relates to the field of parallel resistance heating cables or elements and a methods of making same.

DESCRIPTION OF THE PRIOR ART

Parallel-type heating cables are known in the art. However, so far as is known, in most instances, the cables are constructed in such a way that the heating element is spirally wound about centrally located bus connection cables.

U.S. Pat. Nos. 4,100,673; 3,757,086; 2,494,589; and Canadian Pat. No. 964,709 relate to heating cables wherein the heating element is helically wound along centrally located bus connection cables. This type of cable construction requires a multiple step manufacturing method whereby insulation is either formed between the heating element and the bus wires or insulation is periodically stripped from the bus wires to provide an exposed area for electrical contact.

U.S. Pat. No. 2,719,907 discloses a cable construction of two parallel bus wires between which is situated a zig-zagged heating wire which at certain points throughout its length is alternately electrically connected to the outerlying parallel bus wires. This patent does not state how the electrical connection is established.

U.S. Pat. No. 2,710,909 does disclose a continuous manufacturing process wherein heating wires are imbedded in an insulating material. However, in this patent, the electrical connection of such wires is not established prior to the application of the insulatingmaterial, nor is the resultingcable one having parallel heating elements. This patent requires the performance of a subsequent manufacturing step, after that in which an insulating material has been applied, to establish the necessary electrical connections.

U.S. Pat. Nos. 4,055,526; 3,964,959; 3,740,529; 3,683,361; 3,341,690; 2,559,077; and 2,251,697 relate generally to heating cables, machines for their manufacture and methods of manufacturing heating cables.

SUMMARY OF THE INVENTION

Briefly, the present invention comprises a novel parallel-type heating cable and continuous method of manufacturing the same. The present invention overcomes the cumbersome manufacturing methods of the prior art by providing a parallel-type resistance structure that may be manufactured with fewer process steps than that by which prior art cables may be made. The invention provides a practical method of making such parallel type heating cables by electrically connecting the electrical splices a centrally disposed resistive heating wire to two essentially parallel bus wires and then extruding a protective covering thereabout. The "electrical splice" that connects the heating element to the bus wires may itself serve as the heating element.

DESCRIPTION OF THE PREFERRED EMBODIMENT

When referring to the FIGS. 1–7 like letters and reference numbers refer to like elements. Referring now to FIGS. 1–3 and 5–6 the parallel-type heating cable H of this invention generally comprises a heating core C which is encompassed by a flexible protective outer covering or sheath 16. Heating core C comprises a first and second bus wire or strip 10*a* and 10*b*, respectively, generally represented by the letter B, which are spaced apart and arranged essentially parallel relative to one another for carrying electrical current. Resistive heating element R is preferably located between and is electrically connected to bus wires B.

Figure 1:
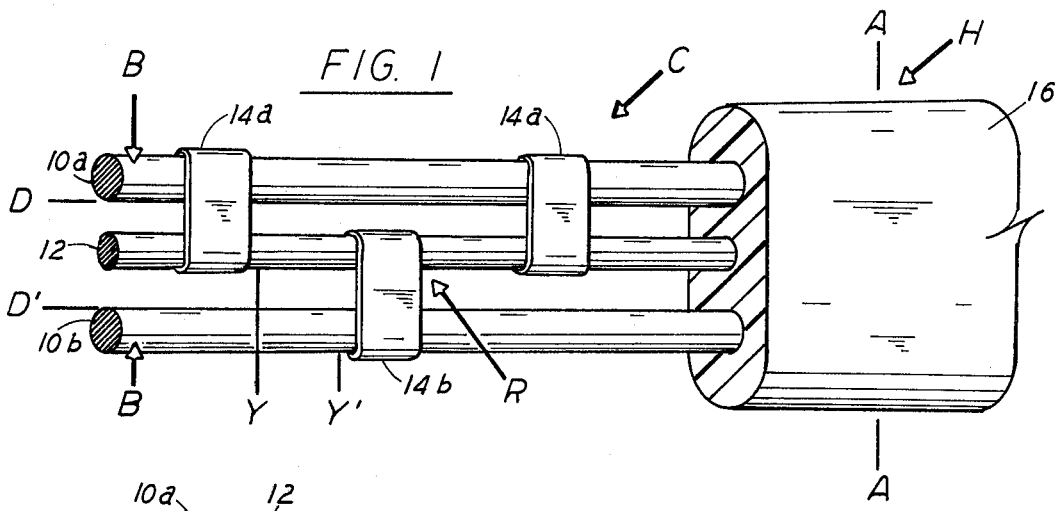
FIG. 1 is a fragmentary perspective view of a cable according to the present invention.
Figure 2:
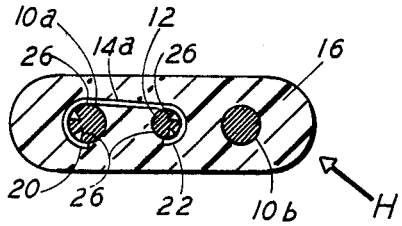
FIG. 2 is a cross-sectional view of FIG. 1 along the line A—A.

In one embodiment of the novel heating cable, FIGS. 1–2, resistive element R is a resistive wire or strip 12 and is arranged essentially parallel, spaced apart, and preferably between bus wires 10*a* and 10*b*. Resistive wire 12 is electrically connected alternately to bus wires 10*a* and 10*b* by electrically conductive splices or staples 14*a* and 14*b* respectively which establishes an alternating series of mechanical-electrical connections between first bus line 10*a* then bus wire 10*b* to resistive wire 12 in a plurality of positions along the lengths of bus wires 10*a* and 10*b* and resistive wire 12. A protective heat conductive and electrically non-conducting covering 16 encompasses heating core C.

The resistive wire 12 comprises an alloy of nickel, chromium and iron such as is marketed by Driver Harris Co., Harris, N. J. under the tradename "Nichrome" or other alloys of nickel and chromium with aluminum or copper providing high electrical resistivity, or other like material which produce a relatively high output of joule heat upon the passage therethrough of electrical current. Bus wires B comprises copper, nickel-coated copper, nickel-copper alloy, aluminum, steel, silver, gold or any other material which is a low resistant conductor of electrical current. Splices 14*a* and 14*b* may be made from either type of conductor or resistive material, provided only that the mechanical properties thereof permit an electrical connection thereof with bus wires B and resistive wire 12 to be established and preferably maintained by a physical deformation of the splice material about such wires. Cover 16 preferably is a flexible, heat-conductive, but nonelectrically conductive material that does not degrade under applicaton of heat. Typical examples of material for cover 16 would include insulating thermoplastic resins such as polyethylene, polytetrafluorine ethylene, polypropylene, polyvinyl chloride, copolymers of ethylene and vinyl acetate, mixtures thereof and other like materials.

Cover 16 may be formed in a planar, cylindrical or triangular shape, or any other desired shape according to desired use.

Figure 5:
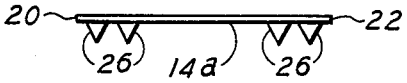
FIG. 5 is a side view of an electrically conductive splice.

Electrically conductive splices 14a (or 14b) comprises a metal strip having first and second end surface 20 and 22 (FIG. 2), which ends 20 and 22 are deformable when applied to bus wires B and resistive wire 12. Upon the application of mechanical force to first end 20 of splice 14a, it is deformed to encircle the major portion of the outer circumference of bus wire 10a. Splice 14b is likewise attached to bus wire 10b. When thus deformed or crimped, splice 14a and 14b physically retains bus wires B in electrical connection with splice 14a and 14b. Splice 14a has a second deformable end surface 22, which in a like manner as that of end 20 may be crimped to resistive wire 12 (or in other embodiments to a second bus wire 10b) to maintain a mechanical-electrical connection. Likewise end surface 22 of splice 14a is crimped to resistive wire 12. Either of end surfaces 20 and 22 may be formed with cleat projections 26 capable, upon the deformation of such end surfaces about bus wires B, of piercing any insulation on bus wires B and to become imbedded in the metal of the conductor wire thereof to maintain a firm physical and electrical connection. FIG. 5 shows a side view of splice 14a prior to ends 20 and 22 being deformed and illustrating cleats 26. Preferably the strips have a thickness of about 0.009 to about 0.025 inch and a width of from about 0.078 to about 0.375 inch. Splices 14a and 14b may, if desired, be soldered to bus wires B and resistive wire 12, although soldering is not generally required.

The complete electrical circuit is from first bus wire 10a through electrically conductive splice 14a to resistive wire 12 and then through splice 14b which connects to the second bus wire 10b. When an electric current flows between bus wires 10a and 10b, the electric current path is through electrical splice 14a and 14b and resistive wire 12 which generates joule heat along the current path. The joule heat elevates the temperature of cable H. This unit, comprising the electrical path from bus wire 10a to bus wire 10b may be repeated as often as desired. As the spacing Y—Y' between splices 14a and 14b is varied, the total resistance of segment of Y—Y' of the resistive heating element R changes proportionately, thereby changing the amount of heat that may be generated at any fixed amount of applied electrical current or voltage. Optimally, the length of a heating cable so designed has heating zone lengths of from ten to twenty-five feet.

If desired, more than two current conducting bus wires B may be used in those embodiments when the cable is to be connected to a three-stage or other source of current.

Alternatively, a high resistance conductive material which generates joule heat upon passage therethrough of electrical current may be used for splices 14a and 14b (FIG. 6) such as "Nichrome" ribbon or the like. When such materials are used, then additional joule heating is developed in the area surrounding splices 14a and 14b. In an embodiment wherein resistive material is used for splices 14a and 14b, such splices may directly form a mechanical-electrical connection between two current carrying bus wires B without the need for a separate and additional resistive wire 12 and thereby serve as the resistive element R itself. The resulting pattern of the heating core C is ladder-like in design or any configuration as desired by the user.

Figure 3:
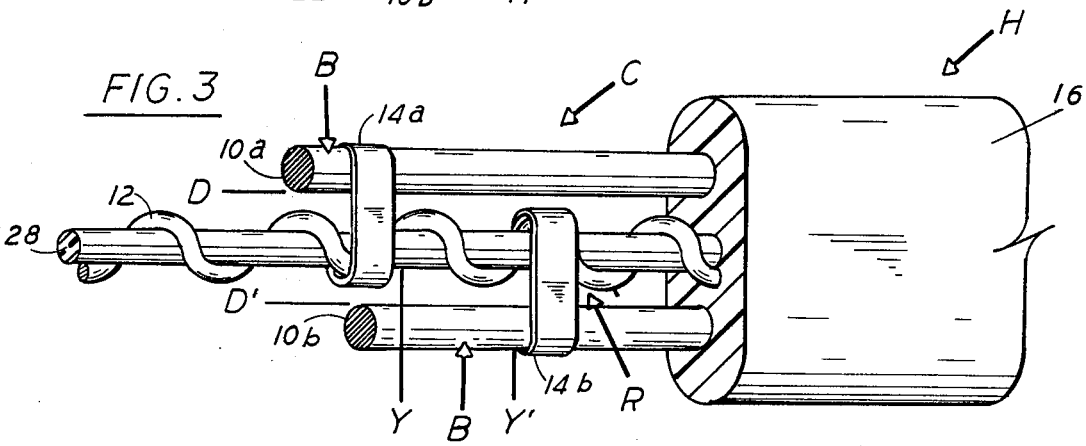
FIG. 3 is a perspective view showing an alternative embodiment for the resistive heating element used in the cables of the present invention.

Another embodiment of a resistive element R useful in cables of the present invention is shown in FIG. 3. The resistive element R in this embodiment comprises a resistive wire 12 helically wound around the outer surface an insulating core 28. Other elements of the cable structure are the same previously described.

The resistive element R in this embodiment is arranged essentially parallel, spaced apart from bus wires B, and preferably between bus wires 10a and 10b. Similary, splices 14a and 14b connect resistive element R to bus wires 10a and 10b respectively. The length of deformable end surface 22 of splices 14a and 14b must be of sufficient length to permit electrical contact to be made with resistive wire 12, as wire 12 is helically wrapped about core 28, when end 22 is mechanically forced to encircle resistive element R such splice end surface 22 physically retains resistive wire 12 in electrical contact with splice 14a and 14b.

The advantage of this embodiment is the addition of mechanical flexibility and a reduction in the heating zone length.

Insulating core 28 may be formd of the same material as cover 16 and preferably is of cylinderical shape with a diameter less than one-half the distance D—D' between bus wires B.

Cables constructed in accordance with the invention may be manufactured in a greatly simplified manner. Broadly, the manufacturing method comprises arranging a first and second bus wire and electrically resistive heating element respectively , into a spaced apart essentially parallel relationship. This step is followed by continuously forming a heating core C from said bus wires B and resistive heating element 12 by deforming a plurality of electrically conductive splices 14a and 14b about said first bus wire 10a and resistive heating element 12 and said second bus wire 10b and resistive heating element 12 to establish an alternating series of mechanical-electrical connections between said first bus wire 10a and resistive heating element 12 and said second bus wire 10b and resistive heating element 12. Finally, continuously covering said heating core C with a protective covering 16.

Figure 4:
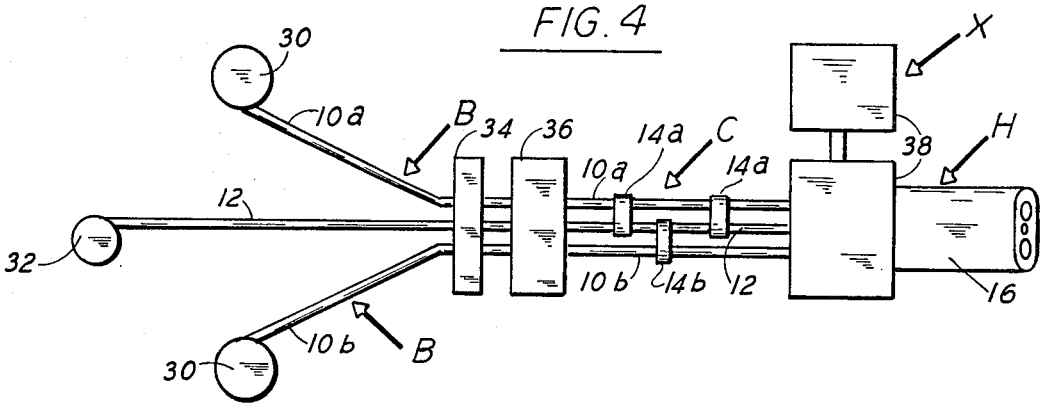
FIG. 4 is a diagrammatic view illustrating one manner of continuously manufacturing cables of the present invention.

A preferred method of manufacture is illustrated in FIG. 4. First and second bus wires 10a and 10b are continuously supplied from bus wire supply spools 30 to straightener 34 which arranges the bus wires into a spaced apart essentially parallel relationship. A resistive heating element, such as resistive wire 12, is supplied from spool 32 to straightener 34 which supplies it between and essentially parallel to bus wires 10a and 10b. From straightener 34 the bus wires and resistive heating element are fed to splicer 36 which operates to deform a plurality of electrically conductive splices about first bus wire 10a and resistive wire 12 and second bus wire 10b and resistive wire 12 to establish an alternating series of mechanical-electrical connections 14a and 14b between the resistive wire 12 and the first and second bus wire 10a and 10b. Placement of the electrically conductive splices 14a and 14b about the bus wires and resistive wire forms the heating core C. As heating core C is continuously formed it is covered with a protective cover 16. As illustrated in FIG. 4, this may be accomplished by feeding the heating core C from splicer 36 as it is formed to an extruder 38 wherein a thermoplastic material is extruded about heating core C to form the protective covering 16.

Figure 6:
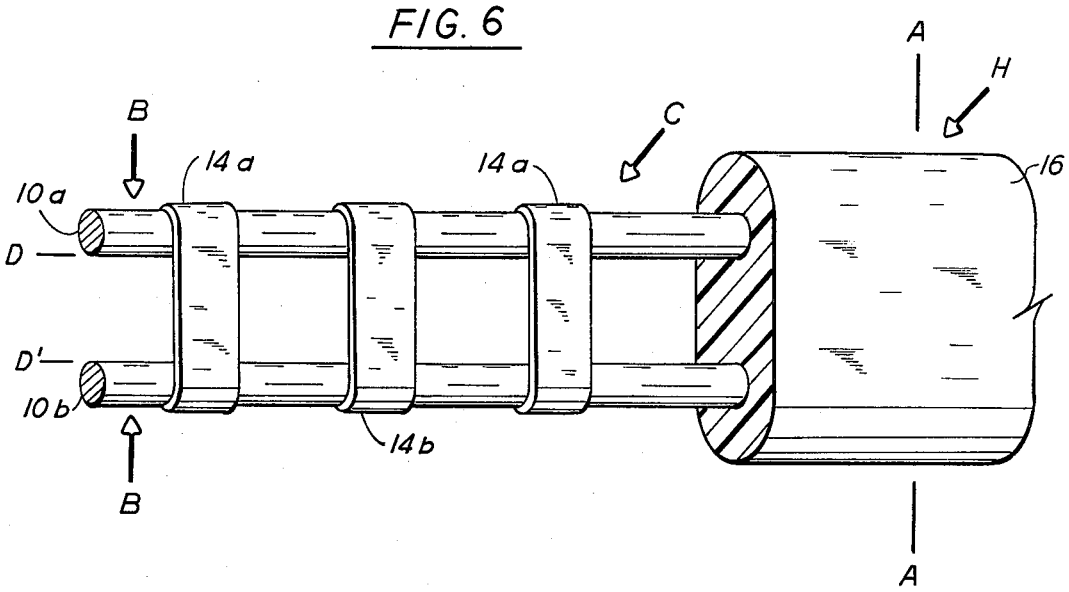
FIG. 6 is a fragmentary perspective view showing another alternative embodiment for the heating core.
Figure 7:
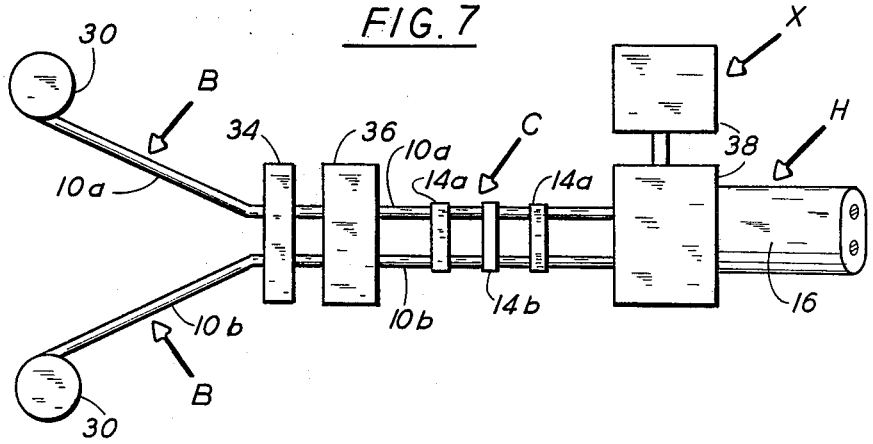
FIG. 7 is a diagrammatic view illustrating a manner of continuously manufcturing cables of FIG. 6.

An alternative method of manufacture for the heating cable illustrated in FIG. 6 is shown in FIG. 7. As above, first and second bus wires 10a and 10b are continuously supplied from bus wire spools 30 to straightener 34 which arranges the bus wires into a space apart essentially parallel relationship. From straightener 34 the bus wires are fed to splicer 36 which operates to form a plurality of electrical splices 14*a* and 14*b*, comprising a high resistance conductive material that generates joule heat upon passage therethrough of electric current, to establish a series of mechanical-electrical connections between the first and second bus wires 10*a* and 10*b*. Placement of the electrical and conductive splices 14*a* and 14*b* about the bus wires forms the heating core C. As heating core C is continuously formed, it is covered with a protective cover 16 as described above.

If splices 14*a* and 14*b* have cleated surfaces 26 on end surfaces 20 or 22 which come into physical contact with bus wires B and resistive wire 12, the splicer 36 can attach or crimp splices 14*a* and 14*b* to bus wires B or resistive wire 12 having insulating coverings or form improved connections by piercing the metal. This yields the advantage of enabling a variety of materials to be used for bus wires B and resistive wire 12 in heating cable H. Splicer 36 may be of any common design, such as the splicer made by General Staple Company, Inc. of New York, N. Y. under the registered trademarks "Autosplice, Insulsplice, Spliceband, Minisplice, and Kingsplice".

Once heating core C is formed by splicer 36, it is fed into an extrusion operation X FIGS. 4 and 7. Extrusion operation X represents generally an extrusion machine 38 that forms cover 16 on the heating core C by extruding an encasing layer of materials as described above.

The advantage of this method is that the number of processing steps in the prior art is greatly reduced while at the same time permitting a continuous cable to be manufactured by continually feeding in bus wires B and resistive heating element 12 from spools 30 and 32 respectively. There is no need to twist bus wires B into a helical shape and remove insulation therefrom prior to the attachment of the resistive heating element as is shown in the prior art. Nor do splices 14*a* and 14*b* have to be soldered to bus wires B and resistive heating element 12. The extrusion process X permits the heating cable H to be formed in many shapes and still include flexibility if desired.

If resistive unit R (FIG. 3) is used, then resistive unit I would run off spool 32 as above. Splicer 36 would attach or crimp splices 14*a* and 14*b* to resistive unit I such that electrical contact is made with resistive wire 12 which is helically wound on insulating core 28.

In addition to the advantage above of reducing the number of processing steps from the prior art, parallel-type heating cables can be made of continually varying lengths. The heating pattern and desired ranges of temperatures can be varied by the user in the selection of materials and the pattern splices. Heating cables of the present invention can be utilized for many purposes such as being wrapped around pipes to heat the fluid therein, being placed on the walls of a container for heating the interior of the container and to heat the water of an aquarium.

The foregoing disclosure and description of the invention are illustrative and explanatory thereof, and various changes in the size, shape and materials as well as in the details of the illustrated construction may be made without departing from the spirit of the invention and all such changes are contemplated as falling within the scope of the appended claims.

We claim:

1. A continuous method of manufacturing parallel-type heating cable, comprising the steps of:

(a) continuously arranging a first and second bus wire into a spaced apart essentially parallel relationship;

(b) continuously supplying a resistive heating element between the essentially parallel to said bus wires;

(c) continuously forming a heating core from said bus wires and resistive heating element by deforming a plurality of electrically conductive splices about said first bus wire and resistive heating element and said second bus wire and resistive heating element to establish an alternating series of mechanical-electrical connections between said first bus wire and resistive heating element and said second bus wire and resistive heating element; and (d) continuously covering said heating element; with a protective covering.

2. The method of claim 1, wherein:

said covering is formed by extruding a thermoplastic resin about said heating core.

3. The method of claim 1, wherein:

said electrically conductive splices have deformable end surfaces which are deformed about said bus wires and resistive heating element by mechanical crimping.

4. The method of claim 3, wherein:

said deformable end surfaces of said splices have cleated projections.

5. The method of claim 1, wherein:

said resistive heating element comprises a resistive heating wire helically wound about an electrically nonconductive core.

6. A continuous method of manufacturing parallel-type heating cable, comprising the steps of:

(a) continuously arranging a first and second bus wire into a spaced apart essentially parallel relationship;

(b) continuously forming a heating core from said bus wires by deforming a plurality of electrical splices, comprising a high resistance conductive material that generates joule heat upon passage therethrough of electric current, about said first and second bus wire to establish a series of mechanical-electrical connections between said first and second bus wire; and (c) continuously covering said heating core with a protective covering.

7. The method of claim 6, wherein:

said covering is formed by extruding a thermoplastic resin about said heating core.

8. The method of claim 6, wherein:

said electrically splices have deformable end surfaces which are deformed about said bus wires and resistive heating element by mechanical crimping.

9. The method of claim 6, wherein:

said deformable end surfaces of said splices have cleated projections.

* * * * *

UNITED STATES PATENT AND TRADEMARK OFFICE

CERTIFICATE OF CORRECTION

PATENT NO. : 4,345,368

DATED : August 24, 1982

INVENTOR(S) : David C. Goss and Daniel R. Springs

It is certified that error appears in the above-identified patent and that said Letters Patent are hereby corrected as shown below:

In the claims:

Claim 8, line 56, change "electrically" to --electrical--;

Claim 8, lines 57-58, delete "and resistive heating element".

Signed and Sealed this

*Third* Day of *April 1984*

[SEAL]

*Attest:*

GERALD J. MOSSINGHOFF

*Attesting Officer*

*Commissioner of Patents and Trademarks*